US009354584B2

(12) United States Patent
Takagami et al.

(10) Patent No.: US 9,354,584 B2
(45) Date of Patent: May 31, 2016

(54) IMAGE FORMING APPARATUS

(71) Applicant: KYOCERA Document Solutions Inc., Osaka (JP)

(72) Inventors: Ai Takagami, Osaka (JP); Yosuke Saito, Osaka (JP); Shigeki Tsukahara, Osaka (JP); Masaki Kadota, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/894,470

(22) PCT Filed: Feb. 19, 2015

(86) PCT No.: PCT/JP2015/054624
§ 371 (c)(1),
(2) Date: Nov. 27, 2015

(87) PCT Pub. No.: WO2015/141373
PCT Pub. Date: Sep. 24, 2015

(65) Prior Publication Data

US 2016/0124372 A1 May 5, 2016

(30) Foreign Application Priority Data

Mar. 20, 2014 (JP) ..... 2014-057903

(51) Int. Cl.
*G03G 15/00* (2006.01)
*G03G 21/20* (2006.01)

(52) U.S. Cl.
CPC ..... *G03G 15/75* (2013.01); *G03G 21/20* (2013.01)

(58) Field of Classification Search
CPC ..... G03G 15/75; G03G 15/751; G03G 21/20
USPC ..... 399/96
See application file for complete search history.

(56) References Cited

U.S. PATENT DOCUMENTS

2009/0052934 A1* 2/2009 Miyaji ..... G03G 21/0058 399/96

FOREIGN PATENT DOCUMENTS

JP 2003-162113 A * 6/2003
JP 2003-162113 A 6/2003

(Continued)

OTHER PUBLICATIONS

International Search Report & Written Opinion issued in PCT/JP2015/054624, mailed Apr. 21, 2015.

*Primary Examiner* — Hoang Ngo
(74) *Attorney, Agent, or Firm* — Studebaker & Brackett PC

(57) ABSTRACT

An image forming apparatus (100) forms an image on a recording medium. The image forming apparatus (100) includes image forming units (110). Of the image forming units (110), one or more image forming units are intermediate image forming units, and one or more image forming units adjacent to a side of the intermediate image forming units and one or more image forming units adjacent to an opposite side of the intermediate image forming units are side image forming units. The image forming units (110) each include a photosensitive drum (120), a light emitting element (162) performing static elimination on the photosensitive drum (120), and a heating element (163) heating the photosensitive drum (120). The heating elements (163) of the intermediate image forming units receive supply of electric power different in quantity from that of which supply the heating elements (163) the side image forming units receive.

6 Claims, 7 Drawing Sheets

(56) References Cited

FOREIGN PATENT DOCUMENTS

| | | | |
|---|---|---|---|
| JP | P2003-162113 A * | 6/2003 | |
| JP | 2007-219117 A | 8/2007 | |
| JP | 2007-264167 A | 10/2007 | |
| JP | 2008-026441 A | 2/2008 | |

* cited by examiner

IMAGE FORMING APPARATUS

TECHNICAL FIELD

The present invention relates to image forming apparatuses.

BACKGROUND ART

An image forming apparatus utilizing an electrophotographic process includes a plurality of image forming units for respective colors (black, yellow, cyan, and magenta). On the surface of a photosensitive drum in the image forming units each include, an electrostatic latent image is formed and developed into a toner image for visualization. Such an image forming unit includes a static eliminator for eliminating static electricity and an electrostatic latent image that remain redundantly on the surface of the photosensitive drum. The static eliminator performs static elimination by irradiating the surface of the photosensitive drum with light.

In view of environmental friendliness, amorphous silicon, which is excellent in abrasion resistance and durable under long-term use, is used generally in the photosensitive drum. Amorphous silicon has a surface having a molecular structure that is apt to adsorb moisture. As a result, moisture is liable to be adsorbed into the surface of the photosensitive drum. When moisture is adsorbed into the surface of the photosensitive drum, the surface resistance of the photosensitive drum may decrease, thereby reducing the surface potential at an edge of the electrostatic latent image. As a result, image quality may degrade.

In view of the foregoing, it has been proposed to provide in the vicinity of the photosensitive drum, a substrate on which a heating element that heats the surface of the photosensitive drum is mounted (e.g., Patent Literature 1). In an image forming apparatus recited in Patent Literature 1, a light emitting element that eliminates static electricity on the photosensitive drum is mounted on one of main surfaces of the substrate while the heating element that heats the photosensitive drum is mounted on the other main surface of the substrate.

CITATION LIST

Patent Literature

[Patent Literature]

Japanese Patent Application Laid-Open Publication No. 2007-264167

SUMMARY OF INVENTION

Technical Problem

However, in a configuration in which equivalent electric power is supplied to heating elements of image forming units located on opposite sides in an image forming section and of image forming units located in the middle of the image forming section where the respective opposite ends corresponding to upstream and downstream sides (entering side and discharge side) in terms of a direction in which paper enters respective developing devices in the image forming apparatus recited in Patent Literature 1, temperature variation differs between photosensitive drums included in the image forming units located on the opposite sides and photosensitive drums included in the image forming units located in the middle. For this reason, temperature may be uneven among the photosensitive drums and the photosensitive drums on the opposite sides may be heated insufficiently. As a result, degradation of image quality caused due to image deletion in a high humidity environment cannot be prevented.

The present invention has been made in view of the aforementioned problems and has its objective of providing an image forming apparatus in which degradation of image quality caused due to image deletion in a high humidity environment can be prevented.

Solution to Problem

An image forming apparatus according to the present invention is an image forming apparatus that forms an image on a recording medium and includes a plurality of image forming units. Of the plurality of image forming units, one or more image forming units are intermediate image forming units, and one or more image forming units adjacent to a side of the intermediate image forming units and one or more image forming units adjacent to an opposite side of the intermediate image forming units are side image forming units. The plurality of image forming units each include a photosensitive drum, a light emitting element that performs static elimination on the photosensitive drum, and a heating element that heats the photosensitive drum. The heating element of each of the intermediate image forming units receives supply of electric power different in quantity from electric power of which supply the heating element of each of the side image forming units receives.

Advantageous Effects of Invention

According to the present invention, an image forming apparatus can be provided in which degradation of image quality caused due to image deletion in a high humidity environment can be prevented.

DESCRIPTION OF EMBODIMENTS

Figure 1:
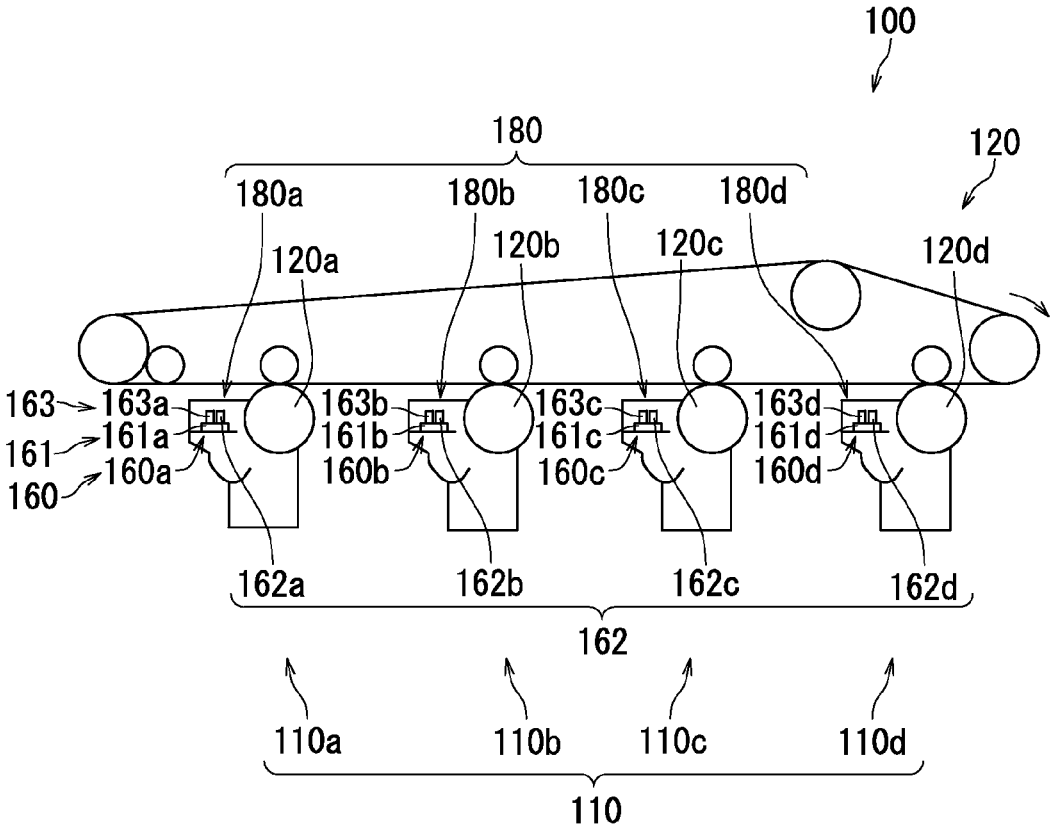
FIG. 1 is a schematic diagram illustrating an arrangement of a plurality of image forming units according to an embodiment.

Hereinafter, an embodiment of the present invention will be described with reference to the accompanying drawings. Note that elements that are the same or equivalent are indicated by the same reference signs in the drawings and description thereof is not repeated.

FIG. 1 is a schematic diagram illustrating an arrangement of a plurality of image forming units 110 according to the present embodiment. An image forming apparatus 100 includes a plurality of image forming units 110*a*-110*d* as the image forming units 110. The image forming unit 110*b* is disposed between the image forming units 110*a* and 110*c*. The image forming unit 110*c* is disposed between the image forming units 110*b* and 110*d*. The image forming units 110*b* and 110*c* located between the image forming units 110*a* and 110*d* are each referred to as an intermediate image forming unit, while the respective image forming units 110*a* and 110*d* located on the opposite sides of the intermediate image forming units are each referred to as a side image forming unit. FIG. 1 illustrates part of the image forming apparatus 100 and does not illustrate developing devices and the like for the sake of clear description.

Each of the image forming units 110 includes a photosensitive drum 120, a cleaner 180, and a developing device. The cleaner 180 includes a static eliminator 160. The static eliminator 160 includes a substrate 161, heating elements 163, and light emitting elements 162.

The image forming unit 110*a* includes a photosensitive drum 120*a*, a cleaner 180*a*, and a developing device. The cleaner 180*a* includes a static eliminator 160*a*. The static eliminator 160*a* includes a substrate 161*a*, heating elements 163*a*, and light emitting elements 162*a*. The image forming units 110*b* includes a photosensitive drum 120*b*, a cleaner 180*b*, and a developing device. The cleaner 180*b* includes a static eliminator 160*b*. The static eliminator 160*b* includes a substrate 161*b*, heating elements 163*b*, and light emitting elements 162*b*. The image forming unit 110*c* includes a photosensitive drum 120*c*, a cleaner 180*c*, and a developing device. The cleaner 180*c* includes a static eliminator 160*c*. The static eliminator 160*c* includes a substrate 161*c*, heating elements 163*c*, and light emitting elements 162*c*. The image forming unit 110*d* includes a photosensitive drum 120*d*, a cleaner 180*d*, and a developing device. The cleaner 180*d* includes a static eliminator 160*d*. The static eliminator 160*d* includes a substrate 161*d*, heating elements 163*d*, and light emitting elements 162*d*.

The light emitting elements 162 eliminate static electricity from corresponding photosensitive drums 120 by irradiating the surfaces of the corresponding photosensitive drums 120 with light. The respective heating elements 163 heat corresponding photosensitive drums 120 to evaporate moisture on the surfaces of the corresponding photosensitive drums 120.

Figure 2:
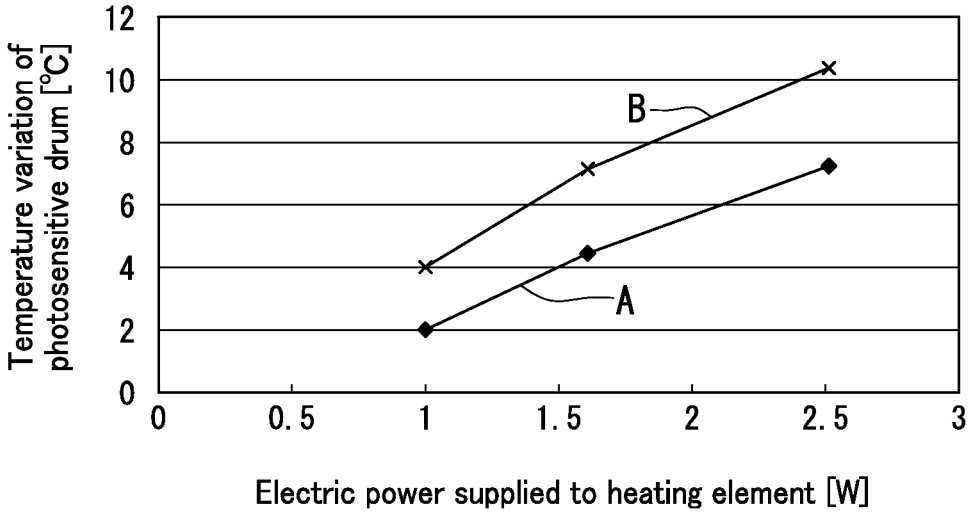
FIG. 2 is a graph representation indicating temperature variations of respective photosensitive drums with respect to supplied electric power.

FIG. 2 is a graph representation indicating temperature variations of respective photosensitive drums with respect to electric power supplied thereto. In order to heat the photosensitive drums, electric power is supplied to heating elements. In FIG. 2, a graph A represents a temperature variation of a photosensitive drum A located on a side among a plurality of photosensitive drums and a graph B represents a temperature variation of a photosensitive drum B located intermediately of the plurality of photosensitive drums. FIG. 2 indicates results of temperature measurement on the photosensitive drums A and B after five hours elapses from power supply. It can be understood that in a condition in which equivalent electric power is supplied to heating elements A located close to the photosensitive drum A and heating elements B located close to the photosensitive drum B, the temperature variation of the photosensitive drum B is greater than that of the photosensitive drum A. The photosensitive drum A is heated by the heating elements A. The photosensitive drum B is heated by the heating elements A and the heating elements B.

Figure 3:
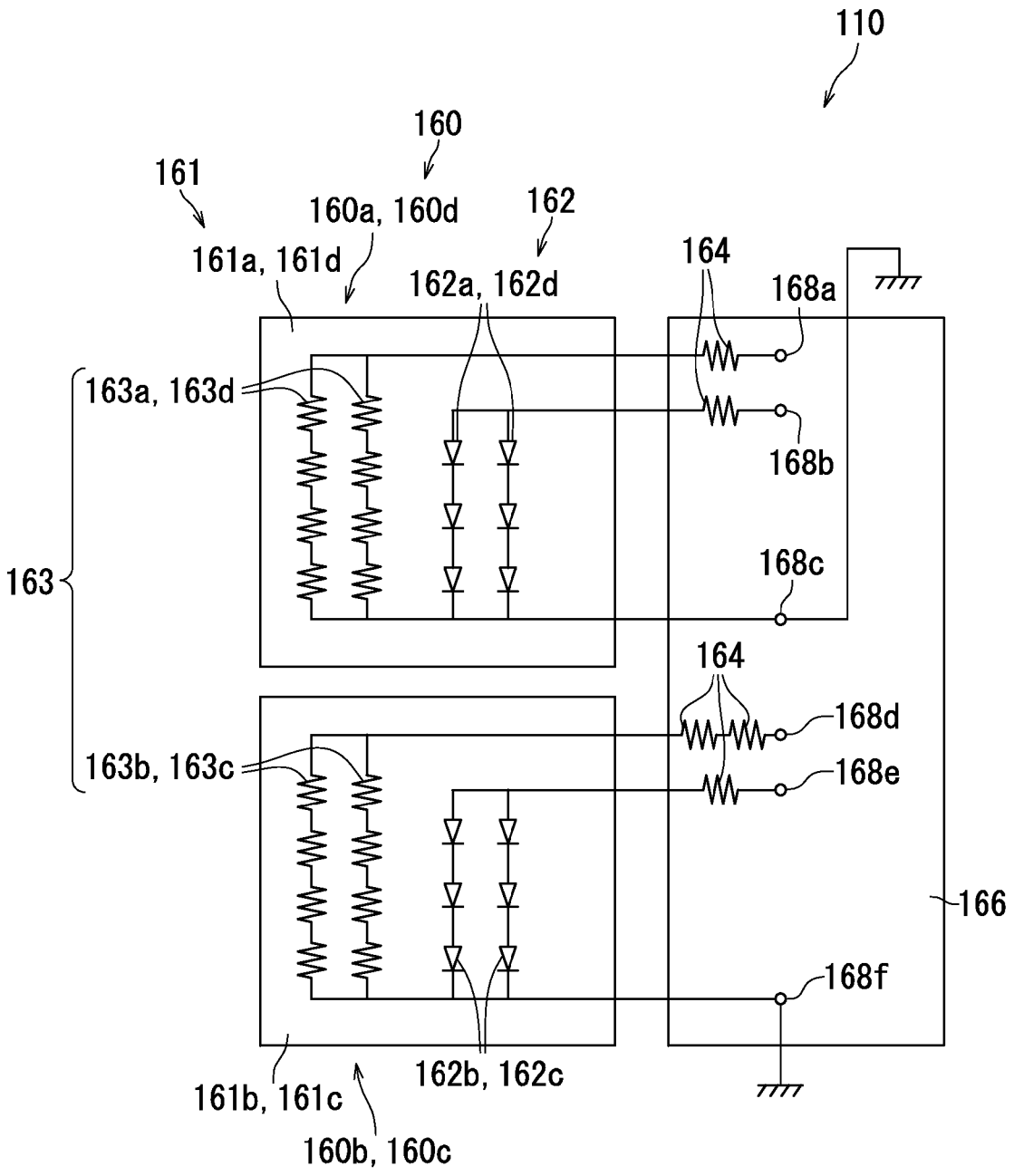
FIG. 3 is a circuit diagram of an image forming unit according to the embodiment.

FIG. 3 is a circuit diagram of one of the image forming units 110 according to the present embodiment. In the image forming apparatus 100, the light emitting elements 162 may be light emitting diodes, for example. The heating elements 163 may be resistance elements, for example. The image forming units 110 may further include a control board 166. The control board 166 includes electricity receiving terminals 168*a*, 168*b*, 168*d*, and 168*e* for input and electricity receiving terminals 168*c* and 168*f* for output. Electric power is supplied to the light emitting elements 162*a* and 162*d*, and heating element 163*a* and 163*d* through the electricity receiving terminals 168*b* and 168*a*, respectively. Also, electric power is supplied to the light emitting elements 162*b* and 162*c* and the heating elements 163*b* and 163*c* through the electricity receiving terminals 168*e* and 168*d*, respectively. Two or more series circuits are each constituted by one or more of the corresponding light emitting elements 162*a*-162*d*. These series circuits are connected together in parallel. Two or more series circuits are each constituted by one or more of the corresponding heating elements 163*a*-163*d*. These series circuits are connected together in parallel. Note that the electricity receiving terminals 168*a*-168*f* are not limited specifically and may be through holes or connectors.

In order to equalize the temperature variation of the photosensitive drums 120*a* and 120*d* with the temperature variation of the photosensitive drums 120*b* and 120*c*, electric power supplied to the heating elements 163*a*-163*d* is adjusted so that the heating elements 163*a* and 163*d* receive supply of electric power different from electric power of which supply the heating elements 163*b* and 163*c* receives. The control board 166 includes limiting resistors 164. The limiting resistors 164 each control a current value of corresponding heating elements 163 to adjust heat quantity of the heating elements 163.

The limiting resistors that adjust electric current to the heating elements are mounted on the control board. Values of limiting resistance depend on the corresponding image forming units. For example, the numbers of limiting resistors 164 may differ among the circuits of the respective heating elements 163*a*-163*d*. Specifically, the number of limiting resistors 164 for the circuits of the heating elements 163*b* or 163*c* is greater than the number of limiting resistors 164 for the circuits of the heating elements 163*a* or 163*d*. In the above configuration, the heat quantity of the heating elements 163 can be finely adjusted. Note that the respective limiting resistors 164 for the respective circuits of the respective heating elements 163*a* and 163*d* may be dispensed with.

Additional limiting resistors 164 control current values of the light emitting elements 162. Through the limiting resistors 164 controlling the current value of the light emitting elements 162, the amount of light that the light emitting elements 162 emit is adjusted. In comparison between a configuration with the limiting resistors 164 on the control board 166 and a configuration with the limiting resistors 164 on the substrate 161, the substrate 161 is not heated by heat of the limiting resistors 164 in the configuration with the limiting resistors 164 on the control board 166. As a result, the photosensitive drums 120 are not heated by the heat of the limiting resistors 164 during static elimination on the photosensitive drums 120 by the light emitting elements 162. Thus, degradation of image quality can be reduced.

The circuits of the light emitting elements 162 and the circuits of the heating element 163 are wired separately from each other on the input side and connected together through common wiring on the output side. In the above circuitry of the image forming unit 110, the light emitting elements 162 and the heating elements 163 can be turned on and off independently of each other. For example, the heating elements 163 can be turned off even in a state in which the light emitting elements 162 are turned on for static elimination on the photosensitive drums 120.

Figure 4:
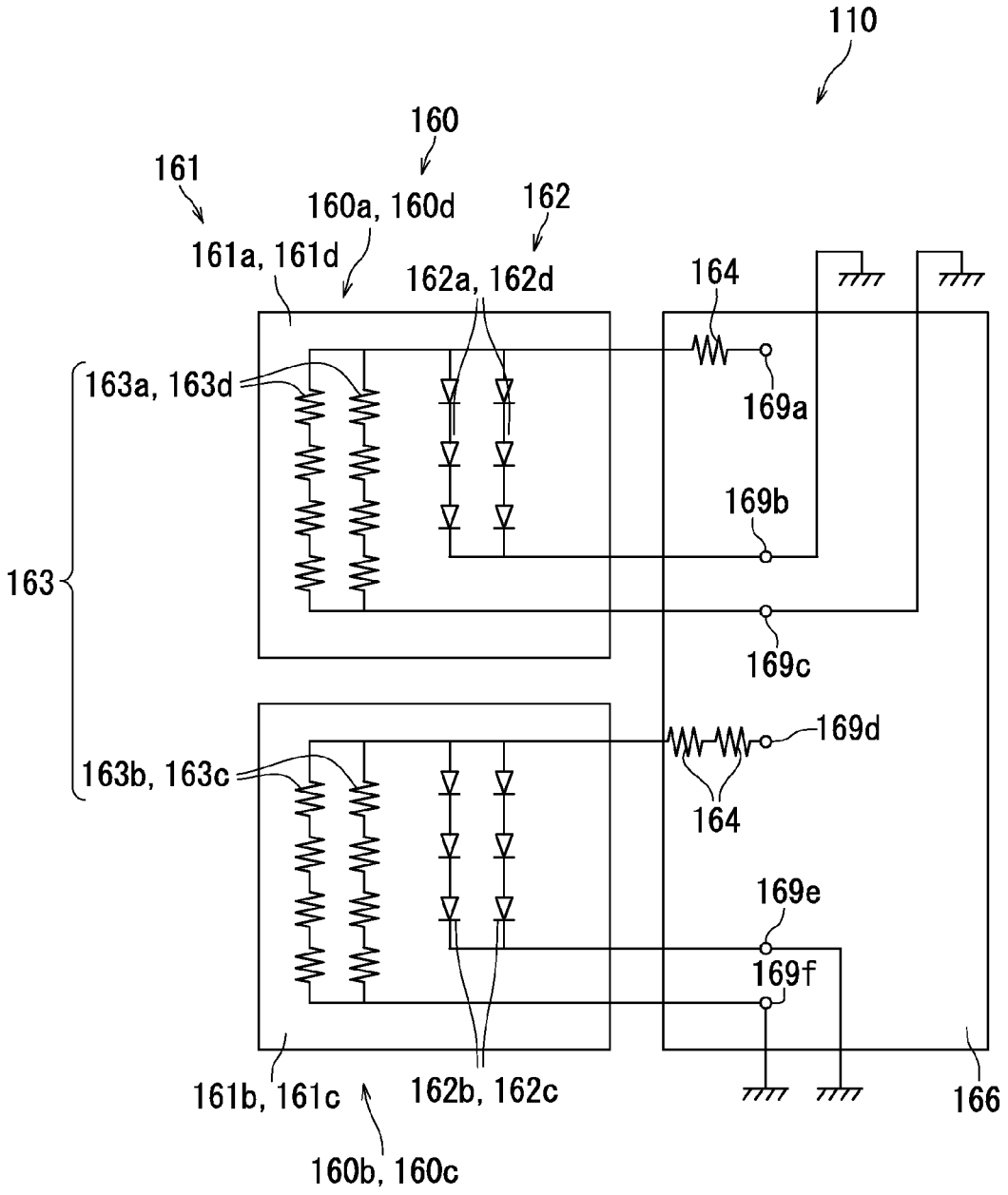
FIG. 4 is another circuit diagram of the image forming unit according to the embodiment.

FIG. 4 is another circuit diagram of the image forming unit 110 according to the present embodiment. The control board 166 includes electricity receiving terminals 169*a* and 169*d* for input and electricity receiving terminals 169*b*, 169*c*, 169*e*, and 169*f* for output. In FIG. 4, the circuitry of the image forming unit 110 is substantially the same as in FIG. 3 except that the circuits of the light emitting elements 162 and the circuits of the heating elements 163 are connected through common wiring on the input side while being wired separately from each other on the output side. In the above circuitry of the image forming unit 110, the same advantages as those obtained in FIG. 3 can be obtained. Further, in comparison between the configuration in which the circuits of the light emitting elements 162 and the circuits of the heating elements 163 are connected through common wiring on the input side and the configuration in which the circuits of the light emitting elements 162 and the circuits of the heating elements 163 are wired separately from each other on the input side, the circuitry is simple and the substrate 161 can be reduced in size in the configuration in which the circuits of the light emitting elements 162 and the circuits of the heating elements 163 are connected through common wiring on the input side.

Figure 5:
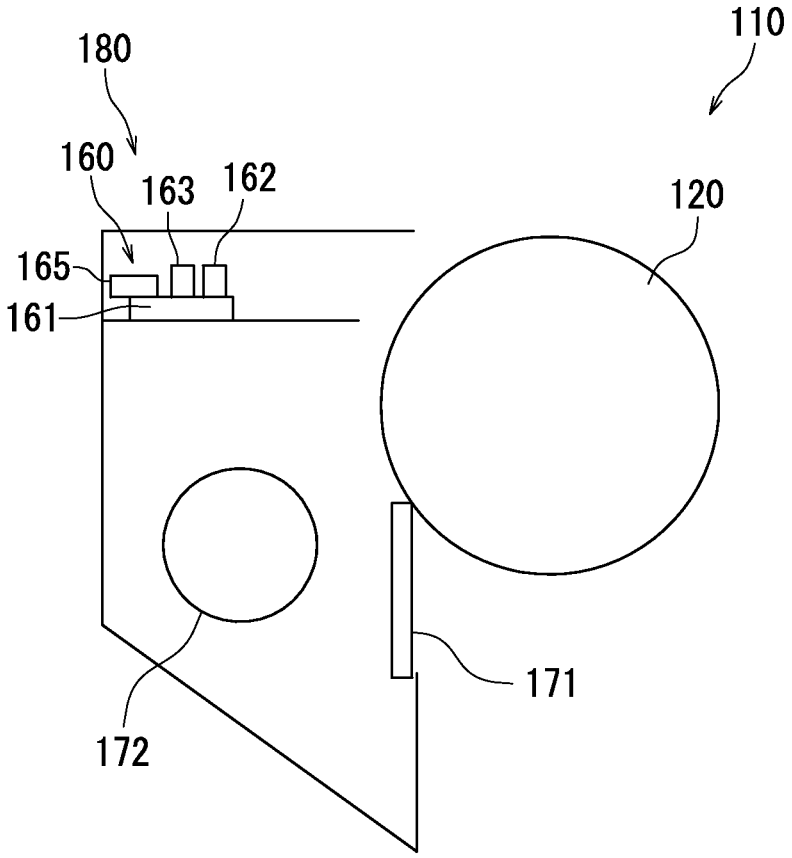
FIG. 5 is a schematic diagram illustrating one image forming unit according to the embodiment.

FIG. 5 is a schematic diagram illustrating the image forming unit 110 according to the present embodiment. The static eliminator 160 eliminates static electricity remaining on the surface of the photosensitive drum 120. The static eliminator 160 may further include substrate warping restraining members 165. As illustrated in FIGS. 1 and 5, the light emitting elements 162 are disposed in parallel to the heating elements 163 in the longitudinal direction of the photosensitive drum 120. Parallel arrangement of the light emitting elements 162 and the heating elements 163 can reduce a man-hour for design.

The substrate warping restraining members 165 restrain the substrate 161 from warping caused by heat of the heating elements 163 and can reduce warping of the substrate 161. The substrate warping restraining members 165 extend in the longitudinal direction of the substrate 161. A material of the substrate warping restraining members 165 is not limited specifically as long as it is an insulating material and may preferably be resin among insulating materials.

The cleaner 180 further includes a cleaning blade 171 and a toner collecting screw 172. The cleaning blade 171 scrapes toner remaining on the surface of the photosensitive drum 120. The toner collecting screw 172 conveys the scraped toner to an end part of a toner collecting path.

Figure 6:
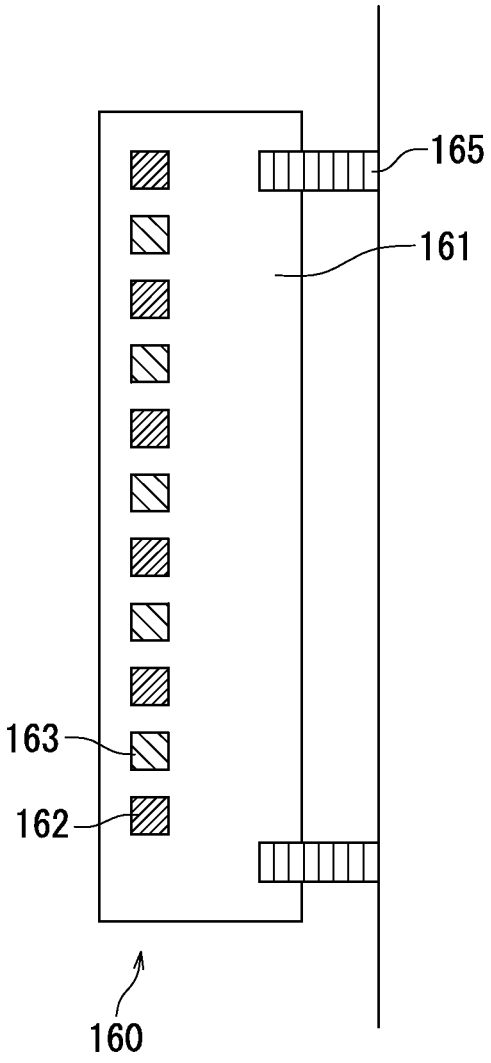
FIG. 6 is a schematic diagram illustrating an arrangement of heating elements and light emitting elements on a substrate according to the embodiment.

FIG. 6 illustrates an arrangement of the heating elements 163 and the light emitting elements 162 on the substrate 161 according to the present embodiment. The light emitting elements 162, the heating elements 163, and the substrate warping restraining members 165 are mounted on one of the main surfaces of the substrate 161.

The substrate warping restraining members 165 are preferably disposed at respective opposite end parts of the substrate 161. In the above configuration, the substrate warping restraining members 165 extend in a direction perpendicular to the longitudinal direction of the substrate 161.

Note that the light emitting elements 162 and the heating elements 163 may be disposed in an alternating manner in a straight line in the longitudinal direction of the photosensitive drum 120, as illustrated in FIG. 6 and different from FIGS. 1 and 5. Moreover, each of the circuitries of the image forming unit 110 illustrated in FIGS. 3 and 4 is applicable to a configuration in which the light emitting elements 162 are disposed in parallel to the heating elements 163 in the longitudinal direction of the photosensitive drum 120 as described with reference to FIGS. 1, 2, and 5 and a configuration in which the light emitting elements 162 and the heating elements 163 are disposed in an alternating manner in a straight line in the longitudinal direction of the photosensitive drum 120.

Figure 7:
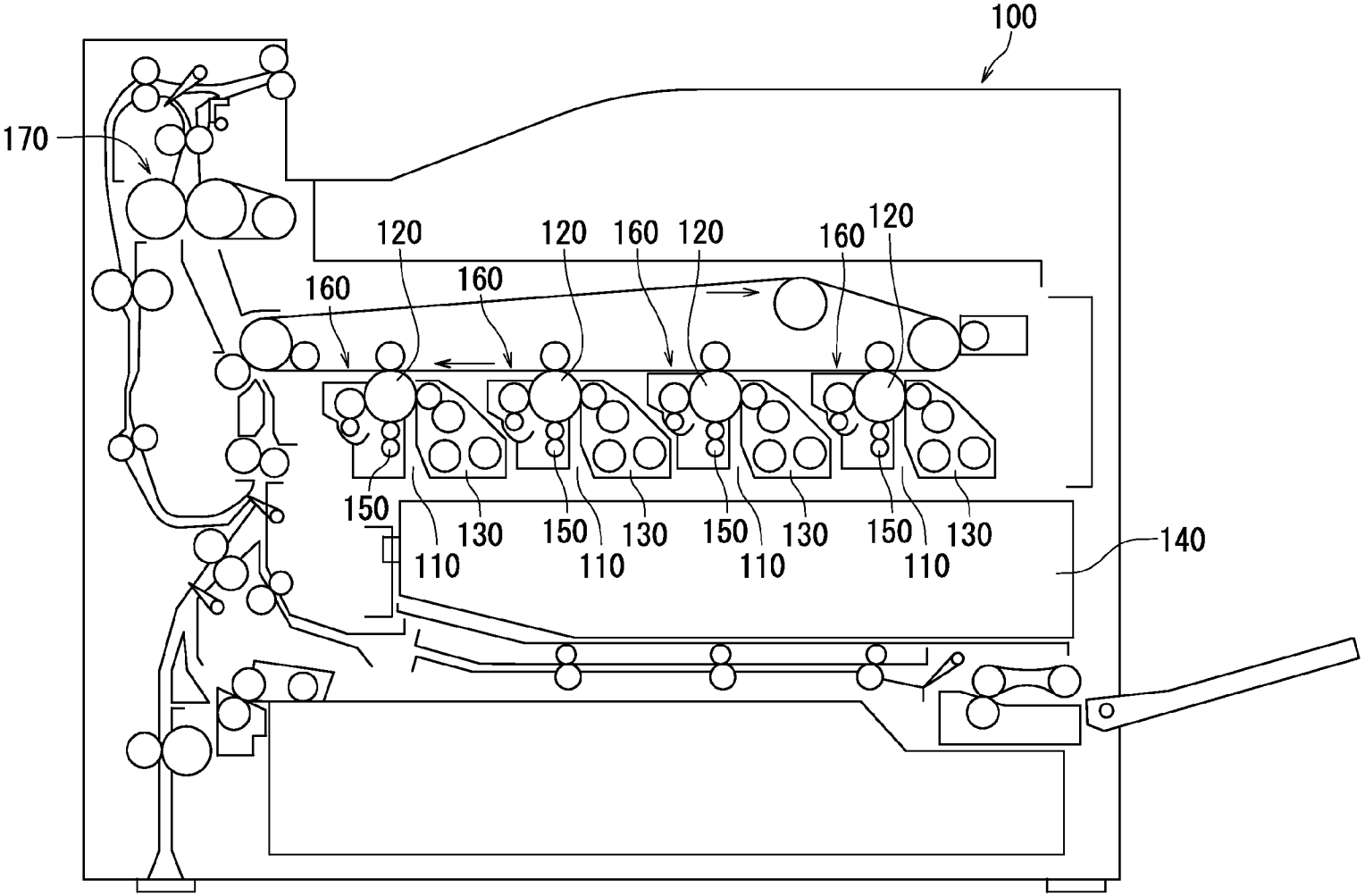
FIG. 7 is a cross sectional view illustrating an internal configuration of an image forming apparatus according to the embodiment.

FIG. 7 is a cross sectional view illustrating an internal configuration of the image forming apparatus 100 according to the present embodiment. The image forming apparatus 100 includes the image forming units 110.

The image forming units 110 include chargers 150, an exposure device 140, developing devices 130, and a fixing device 170 in addition to the photosensitive drums 120 and the static eliminators 160, which are described with reference to FIG. 1. The image forming apparatus 100 may be a printer, for example. The image forming units 110 form an image on a sheet. The respective static eliminators 160 eliminate static electricity on the surfaces of the respective photosensitive drums 120. Note that the static eliminators 160 have been already described with reference to FIGS. 1-6. Therefore, detailed description thereof is omitted.

In image formation, the photosensitive drums 120 rotate counterclockwise and the respective chargers 150 electrostatically charge the surfaces of the respective photosensitive drums 120 uniformly. The exposure device 140 then irradiates the surfaces of the respective photosensitive drums 120 with light based on image data input to an image input section from a personal computer or the like, thereby forming electrostatic latent images on the surfaces of the respective photosensitive drums 120. Next, toners in respective colors fly by developing bias voltage to adhere to the respective electrostatic latent images formed on the surfaces of the respective photosensitive drums 120, thereby forming toner images in the respective developing devices 130.

The toner images in the respective colors formed on the surfaces of the respective photosensitive drums 120 are primarily transferred in succession to an intermediate transfer belt by respective primary transfer rollers to be layered in color. In this manner, a full-color toner image is formed on the surface of the intermediate transfer belt.

Paper to which the full-color toner image is transferred is conveyed to the fixing device 170. Heat and pressure by a fixing roller fix the toner image to the surface of the paper. In this manner, a full-color image is formed. The paper on which the full color image is formed is then ejected outside the main body of the image forming apparatus 100 by an ejection roller.

The embodiment of the present invention has been described so far with reference to FIGS. 1-7. The present invention is not limited to the above embodiment, and various alterations may be made without departing from the spirit and the scope of the present invention. The drawings are schematic illustrations that emphasize elements of configuration in order to facilitate understanding thereof. Therefore, thickness, length, the number, etc. of each of the elements in the drawings may differ from actual ones of the elements for the sake of illustration convenience. Further, the properties of each of the elements, such as material, shape, and dimension thereof described in the above embodiment are mere examples and not limited specifically. The properties of the elements can be modified in various manners within the scope not substantially departing from the advantages of the present invention.

Of the four image forming units 110*a*-110*d* described with reference to FIGS. 1-7, the image forming units 110*b* and 110*c* each serve as an intermediate image forming unit while the image forming units 110*a* and 110*d* each serve as a side image forming unit. The image forming unit 110*b* or 110*c* may serve as an intermediate image forming unit. In a configuration in which, for example, only the image forming unit 110*b* serves as an intermediate image forming unit, the image forming units 110*a*, 110*c*, or 110*d* each serve as a side image forming unit. Alternatively, in a configuration in which, for example, the image forming unit 110*c* serves as an intermediate image forming unit, the image forming units 110*a*, 110*b*, or 110*d* each serve as a side image forming unit. That is, the side image forming units are not limited to only the image forming units located on the opposite sides of the intermediate image forming units among the four image forming units 110*a*-110*d*. The same is applicable to a configuration with three or five or more image forming units.

In the image forming apparatus 100 according to the present invention, degradation of image quality caused due to image deletion in a high humidity environment can be prevented.

INDUSTRIAL APPLICABILITY

The present invention can be utilized in the fields of image forming apparatuses that utilize electrophotographic processes (e.g., printers, copiers, and multifunction peripherals).

The invention claimed is:

1. An image forming apparatus that forms an image on a recording medium, comprising a plurality of image forming units, wherein of the plurality of image forming units, one or more image forming units are intermediate image forming units, and one or more image forming units adjacent to a side of the intermediate image forming units and one or more image forming units adjacent to an opposite side of the intermediate image forming units are side image forming units, the plurality of image forming units each include a photosensitive drum, a light emitting element that performs static elimination on the photosensitive drum, and a heating element that heats the photosensitive drum, the heating element of each of the intermediate image forming units receives supply of electric power different in quantity from electric power of which supply the heating element of each of the side image forming units receives, the light emitting element and the heating element are turned on and off independently of each other, the plurality of image forming units each include a substrate, the light emitting element of each of the image forming units includes a plurality of light emitting elements, the heating element of each of the image forming units includes a plurality of heating elements, and the light emitting elements and the heating elements are disposed in a straight line on one main surface of the substrate.

2. An image forming apparatus that forms an image on a recording medium, comprising a plurality of image forming units, wherein of the plurality of image forming units, one or more image forming units are intermediate image forming units, and one or more image forming units adjacent to a side of the intermediate image forming units and one or more image forming units adjacent to an opposite side of the intermediate image forming units are side image forming units, the plurality of image forming units each include a photosensitive drum, a light emitting element that performs static elimination on the photosensitive drum, and a heating element that heats the photosensitive drum, the heating element of each of the intermediate image forming units receives supply of electric power different in quantity from electric power of which supply the heating element of each of the side image forming units receives, the light emitting element and the heating element are turned on and off independently of each other, the plurality of image forming units each include a substrate, the light emitting element of each of the image forming units includes a plurality of light emitting elements, the heating element of each of the image forming units includes a plurality of heating elements, and the light emitting elements are disposed in parallel to the heating elements on one main surface of the substrate.

3. The image forming apparatus according to claim 1, further comprising a control board including an electricity receiving terminal for input and an electricity receiving terminal for output, wherein the substrate and the control board are independent of and separate from each other.

4. The image forming apparatus according to claim 3, further comprising a limiting resistor configured to adjust electric current to the heating elements and mounted on the control board, the limiting resistor having limiting resistance that depends on a corresponding one of the image forming units.

5. The image forming apparatus according to claim 3, further comprising a limiting resistor configured to adjust electric current to the light emitting elements and mounted on the control board.

6. The image forming apparatus according to claim 1, further comprising a substrate warping restraining member configured to restrain the substrate from warping, wherein the substrate warping restraining member is disposed on the substrate.

* * * * *